US007175486B2

(12) United States Patent
Noro et al.

(10) Patent No.: US 7,175,486 B2
(45) Date of Patent: Feb. 13, 2007

(54) TERMINAL FITTING

(75) Inventors: Yutaka Noro, Yokkaichi (JP); Ryotaro Ishikawa, Yokkaichi (JP); Hajime Kawase, Yokkaichi (JP); Keiichi Nakamura, Yokkaichi (JP); Yutaka Kobayashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/345,357

(22) Filed: Feb. 1, 2006

(65) Prior Publication Data

US 2006/0172616 A1 Aug. 3, 2006

(30) Foreign Application Priority Data

Feb. 2, 2005 (JP) ..... 2005-026665

(51) Int. Cl.
*H01R 13/15* (2006.01)

(52) U.S. Cl. ..... 439/839

(58) Field of Classification Search ..... 439/839, 439/849, 843, 852, 850, 851
See application file for complete search history.

(56) References Cited

U.S. PATENT DOCUMENTS 4,919,628 A * 4/1990 Mobley et al. ..... 439/858
5,235,743 A 8/1993 Endo et al.
5,775,962 A 7/1998 Kakuta et al.
6,010,377 A * 1/2000 Dechelette et al. ..... 439/851
6,244,910 B1 * 6/2001 Grubbs ..... 439/852
2004/0157503 A1 8/2004 Fujii
2006/0172615 A1 * 8/2006 Noro et al. ..... 439/843
2006/0172620 A1 * 8/2006 Noro et al. ..... 439/852

* cited by examiner

*Primary Examiner*—James Harvey
*Assistant Examiner*—Travis Chambers
(74) *Attorney, Agent, or Firm*—Gerald E. Hespos; Anthony J. Casella

(57) ABSTRACT

A terminal fitting (T) has a rectangular tube (10) with a bottom plate (12). A resilient contact (25) extends back into the tube (10) from an end of the bottom plate (12). A base portion (33) is formed at the front end of the bottom plate (12) and is made narrower than the bottom plate (12) by cutting away the left and right edges. A bulge (34) bulges out from a lateral edge of the base portion (33) and narrows an area of an opening between the base portion (33) and the right side plate (13R). Thus, external matter is less likely to intrude into the rectangular tube (10) through the opening even if the resilient contact (25) is narrow. Additionally, the base portion (33) is reinforced by the bulge (34). Thus, the base portion (33) is less likely to be deformed by external matter.

6 Claims, 17 Drawing Sheets

TERMINAL FITTING

BACKGROUND OF THE INVENTION

1. Field of the Invention

The invention relates to a terminal fitting.

2. Description of the Related Art

U.S. Pat. No. 5,235,743 discloses a terminal fitting with a rectangular tube that has a front opening into which a tab is insertable. A resilient contact is provided in the rectangular tube for contacting the tab. The resilient contact is long and narrow along forward and backward directions, and has an arcuate bend that extends continuously form the front end of a bottom plate of the rectangular tube. The resilient contact also has an extending portion that extends back from the bend, and is resiliently deformable with the bend as a support.

A base portion narrower than the bottom plate is formed is formed in some terminal fittings of this type by cutting the left and right edges of a front end of the bottom plate. The bend of the resilient contact is continuous with the front end of the base portion and is easier to deform in view of the narrow dimension. A stress acting when the bent is resiliently deformed is dispersed to the base portion to alleviate stress concentration on the bend.

The left and right edges of the bottom plate are cut to form the narrow base portion of the above-described terminal fitting. However, the cuts create openings between the left and right edges of the base portion and the side plates of the rectangular tube. These openings communicate with the inside of the rectangular tube. The width of the base portion conventionally has been equal to the width of the bend. Thus, areas of openings between the base portion and the side plates become larger as the width of the resilient contact piece increases as against that of the rectangular tube, thereby increasing a possibility of the intrusion of external matter into the rectangular tube through these openings.

Further, the base portion is exposed at the outer surface of the rectangular tube. Thus, there is a possibility that external matter may contact the base portion. As the resilient contact becomes narrower, the width of the base portion becomes smaller to reduce the rigidity of the base portion. Therefore, there is also a possibility that the base portion will be deformed by external matter.

The invention was developed in view of the above problems, and objects of the invention are to prevent the intrusion of an external matter into a tube of a terminal fitting and to prevent deformation of a base portion by interference with external matter even if the resilient contact is narrow.

SUMMARY OF THE INVENTION

The invention relates to a terminal fitting with a tube that includes a base plate. A long narrow resilient contact is disposed in the tube and can contact a tab that has entered the tube. The resilient contact includes a bend that is continuous with the base plate of the tube, an extending portion that extends back from the bent portion, and a base portion that is narrower than the base plate. The base portion is formed with at least one bulge that bulges out from a lateral edge of the base portion towards a side plate of the tube. The bulge narrows an area of an opening formed between the base portion and the side plate. Thus, external matter is not likely to intrude through the opening and into the tube even if the resilient contact is narrow. Further, the base portion becomes wider and is reinforced by the bulge.

Thus, deformation of the base portion is not likely to be deformed by external matter even if the resilient contact piece is narrow.

The base portion preferably is made narrower than the base plate by cutting away one or more lateral edges of the base plate.

The base portion preferably is formed at a front end of the base plate, and most preferably, the bend is substantially continuous with the front end of the base portion.

The widthwise centers of the resilient contact and/or the base portion preferably are deviated from the widthwise center of the tube.

The bulge preferably is formed only at the lateral edge opposite the side towards which the widthwise center of the base is deviated.

The front edge of the bulge preferably is oblique to the longitudinal direction of the resilient contact.

First and second side plates preferably extend from opposite sides of the base plate. A ceiling plate preferably extends from the first side plate and at least one pressing portion extends from the second side plate for preventing outward displacement of the ceiling plate. The ceiling plate preferably is recessed to accommodate at least part of the pressing portion.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A terminal fitting according to the invention is identified by the letter T in FIGS. 1 to 18. The terminal fitting T is accommodated in a connector housing 50 that is made of a synthetic resin. Cavities 51 penetrate the housing 50 in forward and backward directions, and a lock 52 is cantilevered substantially forward along the bottom wall of each cavity 51. A retaining projection 52*a* is formed on the surface of each lock facing the cavity 51.

Figure 12:
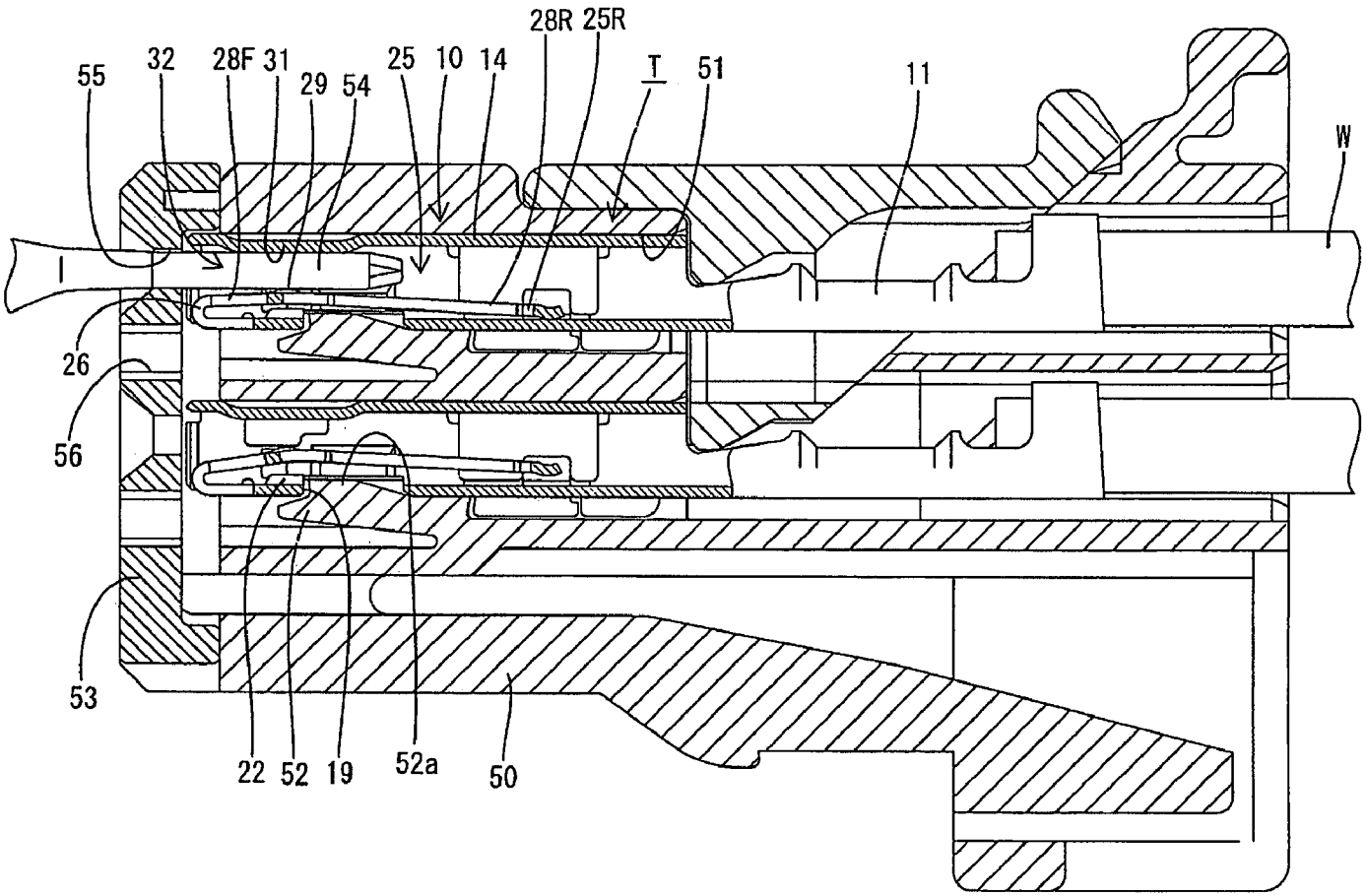
FIG. 12 is a section showing a state where a front plate is at a full locking position and a tab is connected with the terminal fitting.
Figure 13:
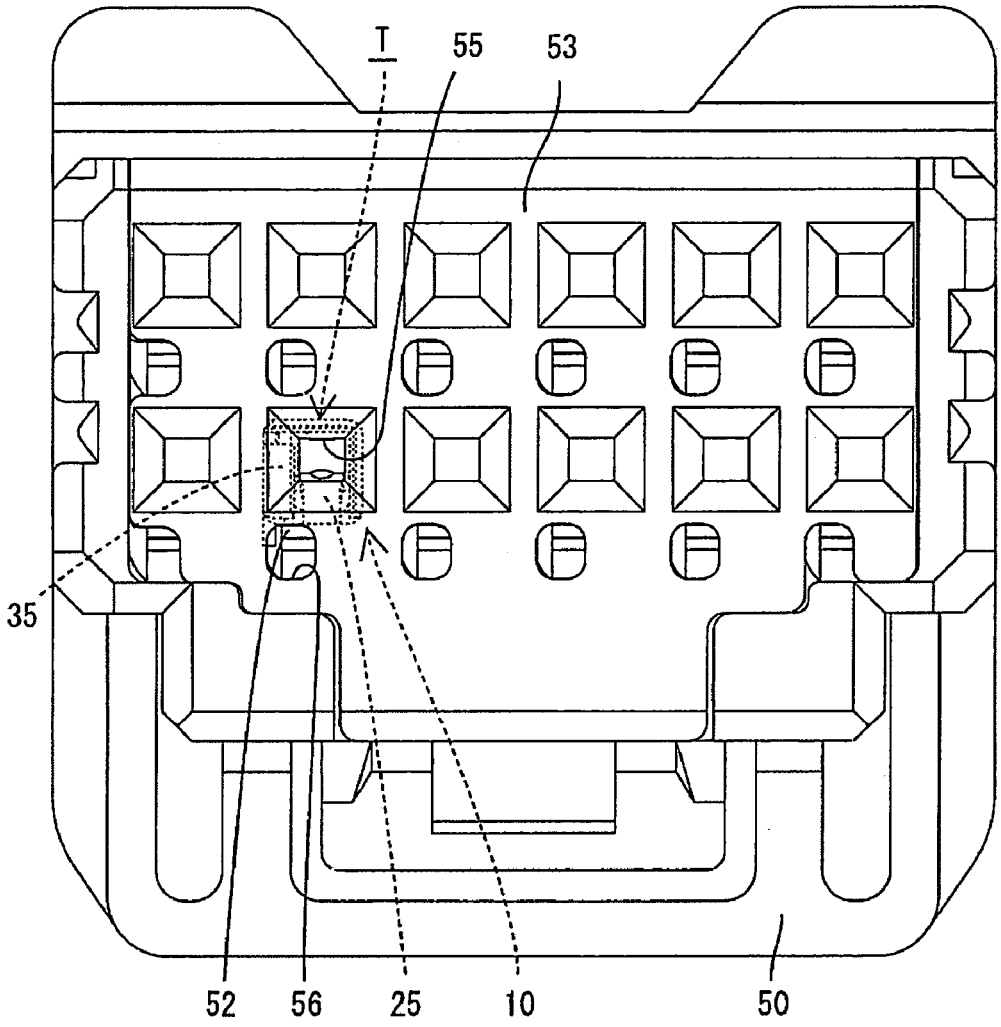
FIG. 13 is a front view of the connector showing a state where the front plate is at the full locking position.
Figure 14:
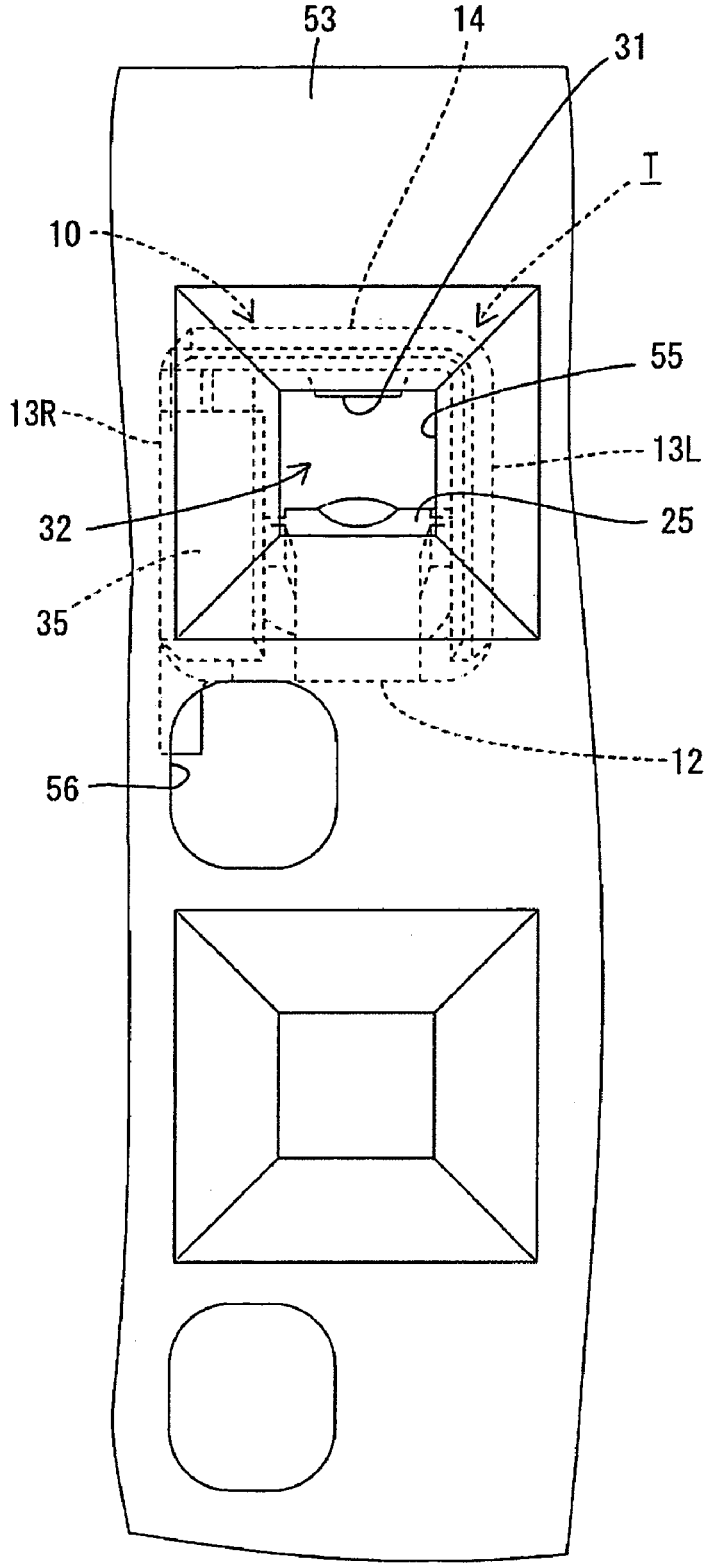
FIG. 14 is a partial enlarged view of FIG. 13.
Figure 15:
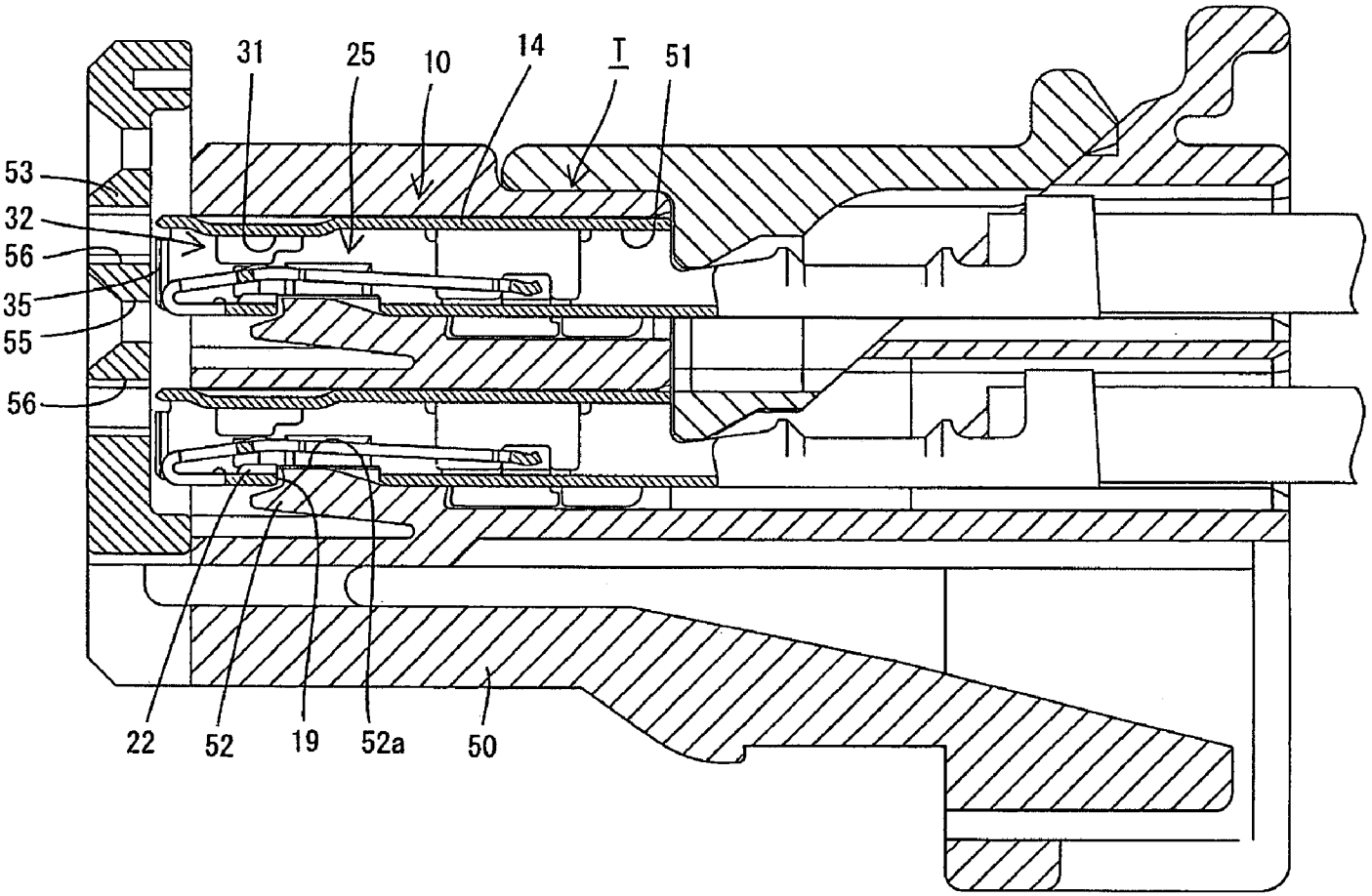
FIG. 15 is a section showing a state where the front plate is at a partial locking position.
Figure 16:
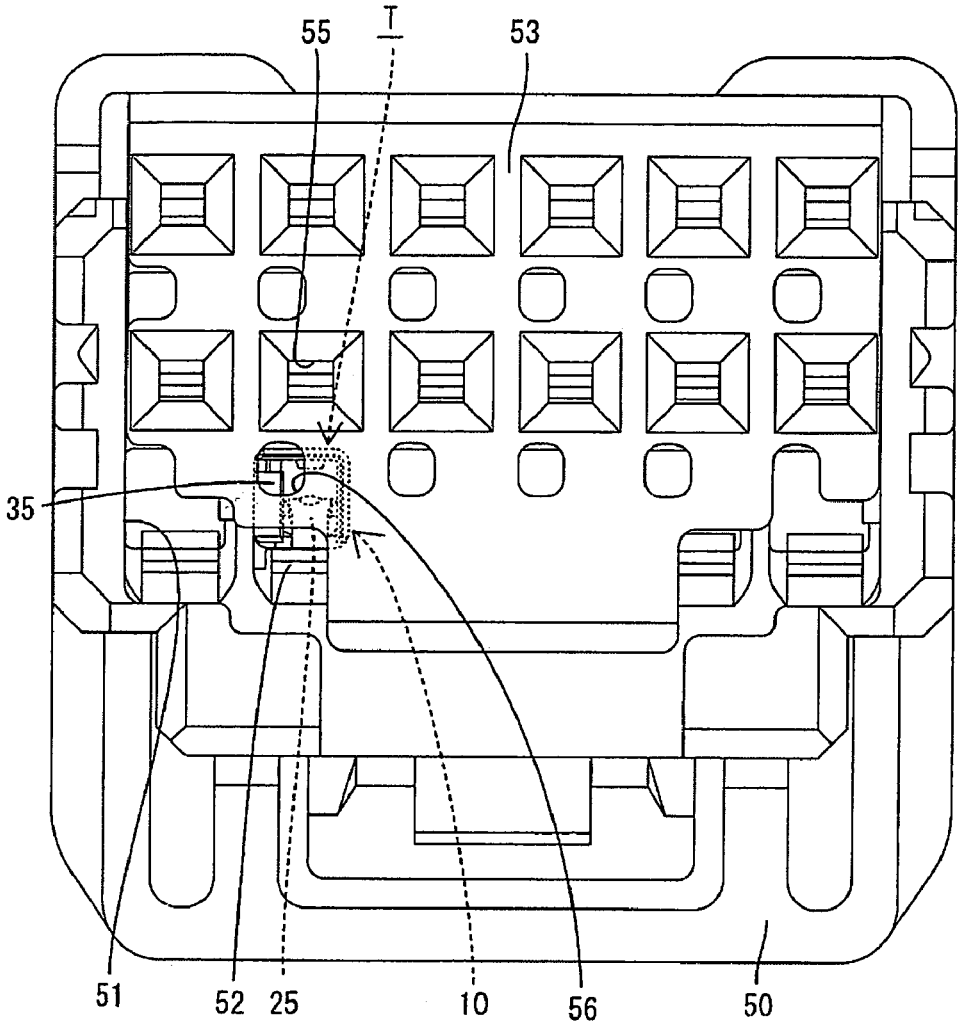
FIG. 16 is a front view of the connector housing showing the state where the front plate is at the partial locking position.
Figure 17:
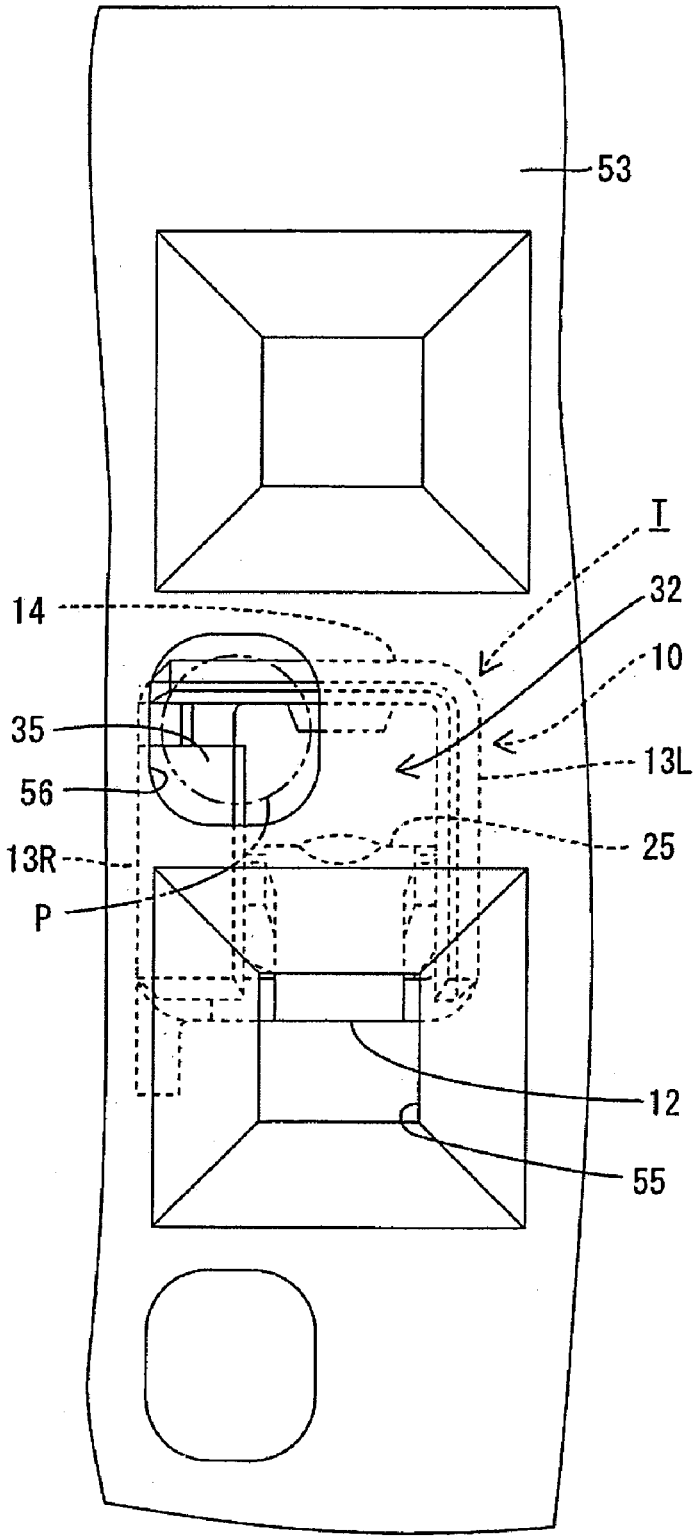
FIG. 17 is a partial enlarged view of FIG. 16.
Figure 18:
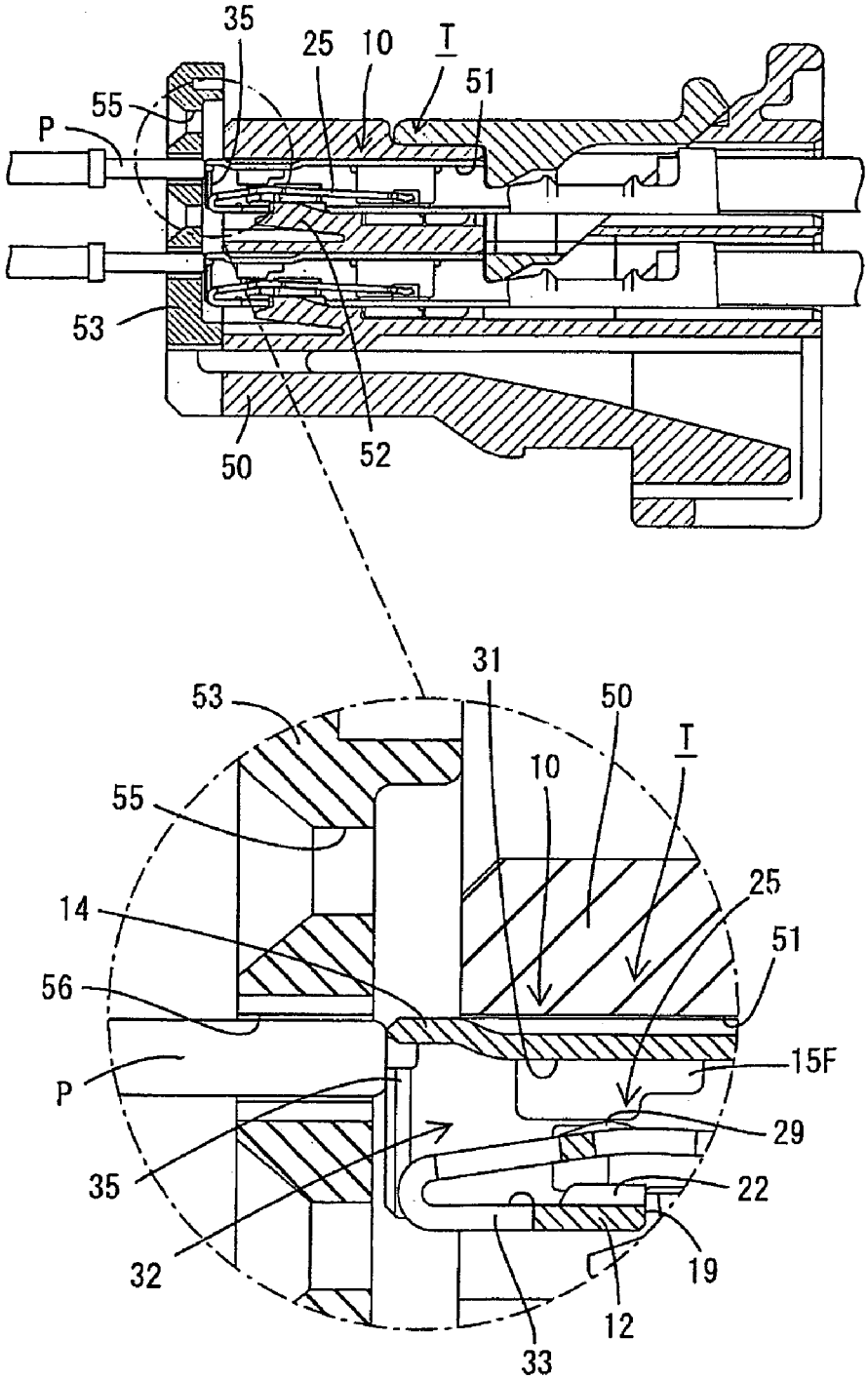
FIG. 18 is a section showing a state where an electrical connection check is performed using a probe.

A front plate 53 is mounted on the front of the housing 50 and is movable vertically between a partial locking position and a full locking position. Tab insertion openings 55 and work openings 56 are formed in the front plate 53 at positions substantially corresponding to the respective cavities 51. The tab insertion openings 55 are slightly above centers of the cavities 51 and the work openings 56 are at positions substantially corresponding to locks 52 when the front plate 53 is at the full locking position, as shown in FIGS. 12 to 14.

Figure 10:
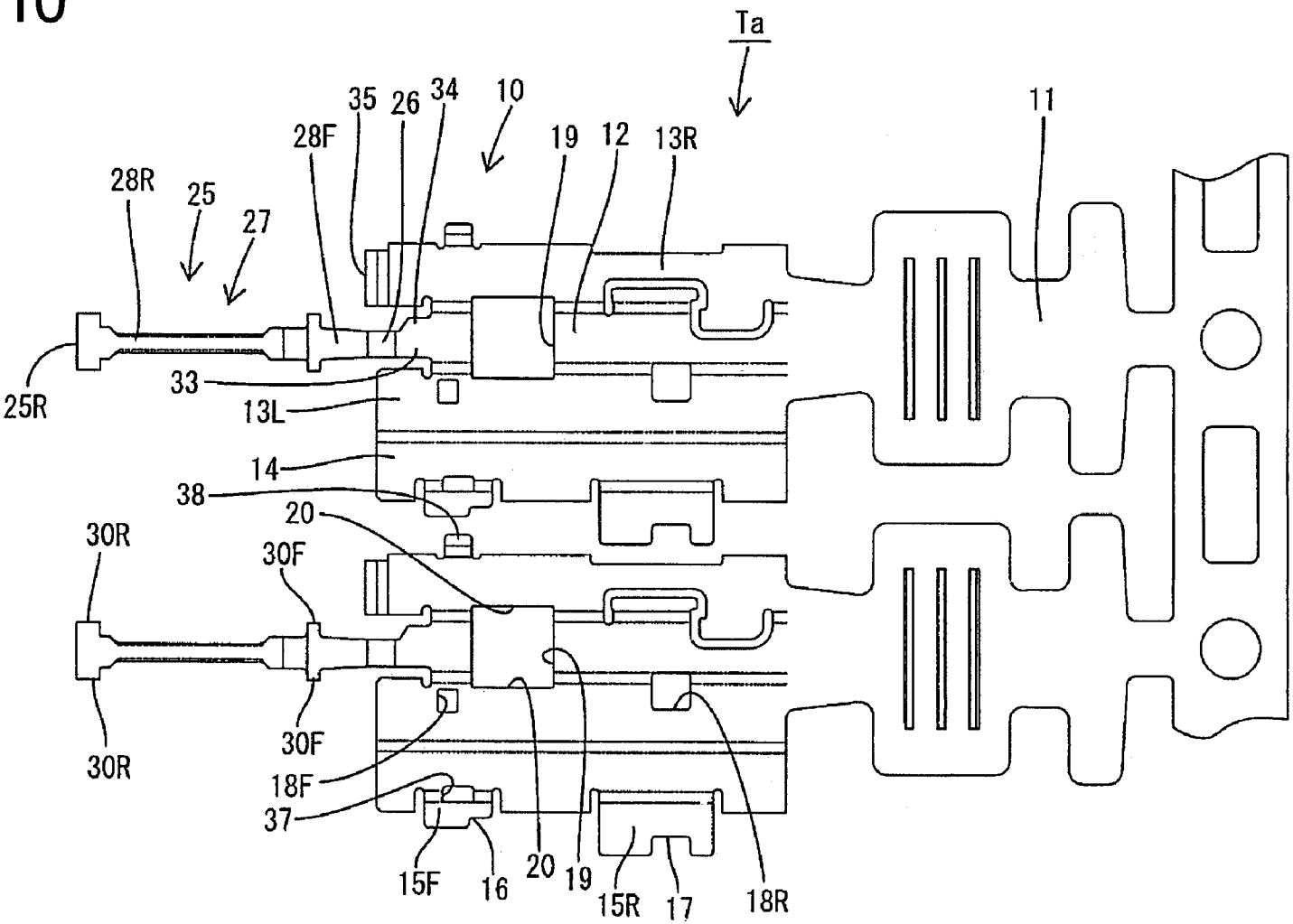
FIG. 10 is a development of the terminal fitting.
Figure 11:
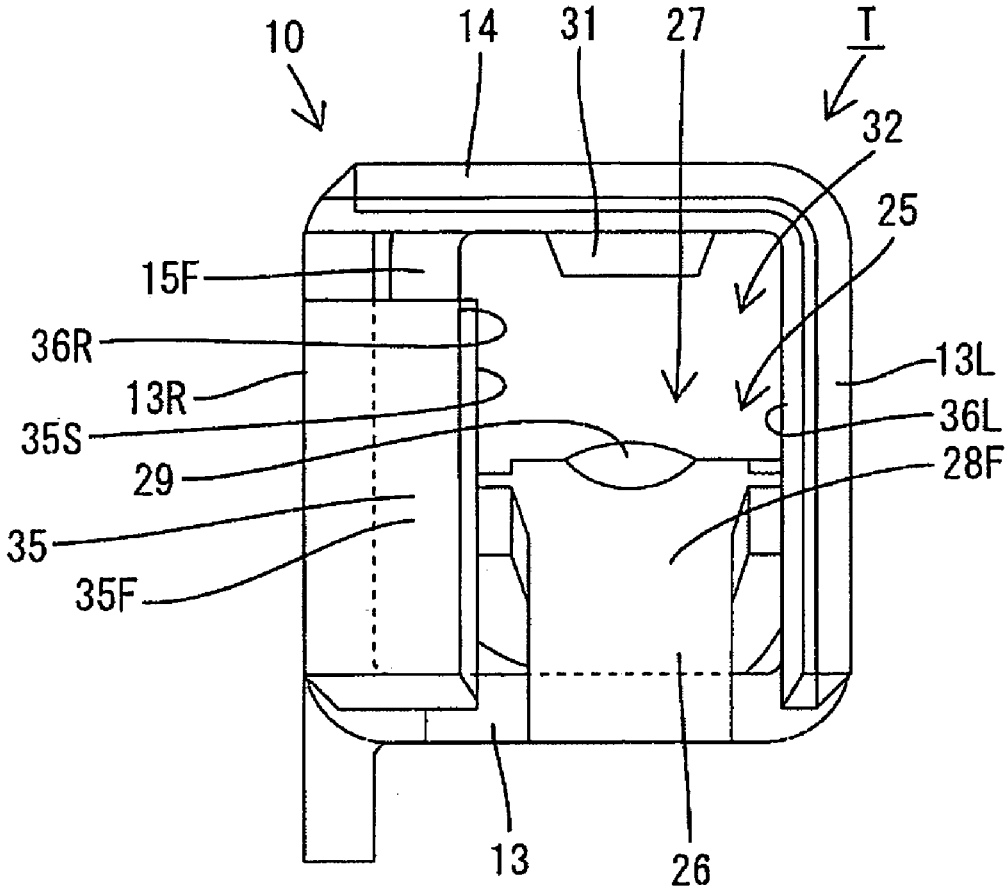
FIG. 11 is a front view of the terminal fitting.

Each terminal fitting T is formed from a conductive metallic plate material Ta stamped or cut out into a specified shape as shown in FIG. 10 by applying bending, folding, pressing, embossing, etc. and is substantially narrow and long in forward and backward directions. A front portion of the plate Ta is configured to form a substantially rectangular tube 10 and a rear portion is configured to form a wire connecting portion 11 with open barrels that can be crimped, bent or folded into electrical connection with an end of a wire W.

The rectangular tube 10 of the terminal T is substantially hollow in forward and backward directions and has a bottom plate 12 that is long and narrow in forward and backward directions. Left and right side plates 13L, 13R project up from the opposite left and right sides of the bottom plate 12. A ceiling plate 14 extends from the top of the left side plate 13L towards the right side plate 13R and is substantially parallel with the bottom plate 12. Front, rear and intermediate parts of the extending right edge of the ceiling plate 14 contact the upper edge of the right side plate 13R from above, and front and rear locking plates 15F, 15R are formed in front and rear areas of the extending end of the ceiling plate 14 that do not contact the upper edge of the right side plate 13R. The locking plates 15F, 15R extend down substantially along the inner surface of the right side plate 13R. The front locking plate 15F is substantially rectangular and the bottom edge thereof is in an intermediate position of the rectangular tube 10 with respect to the height direction. A rear notch 16 is formed at the rear end of the bottom edge of the front locking plate 15F. The rear locking plate 15R also is substantially rectangular, and the bottom edge thereof is at a low position near the bottom plate 12 in the rectangular tube 10. A bottom notch 17 is formed in an intermediate position of the bottom edge of the rear locking plate with respect to forward and backward directions. Substantially rectangular front and rear locking holes 18F, 18R penetrate the left side plate at positions corresponding respectively to the bottom edge of the front locking plate 15F and the bottom notch 17 of the rear locking plate 15R.

A substantially rectangular locking hole 19 is formed in the bottom plate 12. Additionally, the bottom edges of the left and right side plates 13L, 13R are cut to a position slightly higher than the upper surface of the bottom plate 12 in areas corresponding to the locking hole 19 with respect to forward and backward directions to form transversely symmetrical side notches 20. Thus, the left and right side plates 13L, 13R have bottom edges in the opening area of the locking hole 19. An area of the bottom part of the right side plate 13R corresponding to the locking hole 19 is embossed to project inward towards the widthwise center, thereby forming an intrusion restricting portion 21. The intrusion restricting portion 21 is substantially rectangular in side view (see e.g. FIG. 3) and is substantially trapezoidal in bottom view (see e.g. FIG. 4). The rear notch 16 of the front locking plate 15F is formed to avoid interference with the front end of the upper edge of the intrusion restricting portion 21.

A retaining portion 22 is formed at the front edge of the locking hole 19. The retaining portion 22 is formed by plastically deforming the opening edge of the locking hole 19 in the bottom plate 12 by stamping or embossing to project up and into the rectangular tube 10. The retaining portion 22 includes an edge 12S of the locking hole 19 that will oppose and engage the retaining projection 52*a* of the lock 52 of the housing 50. The retaining portion 22 is displaced to the left along the width direction relative to the rectangular tube 10. Further, the upper surface of the retaining portion 22 is a substantially flat surface located substantially at the same height as the bottom edges of the side notches 20 and the intrusion restricting portion 21.

Figure 1:
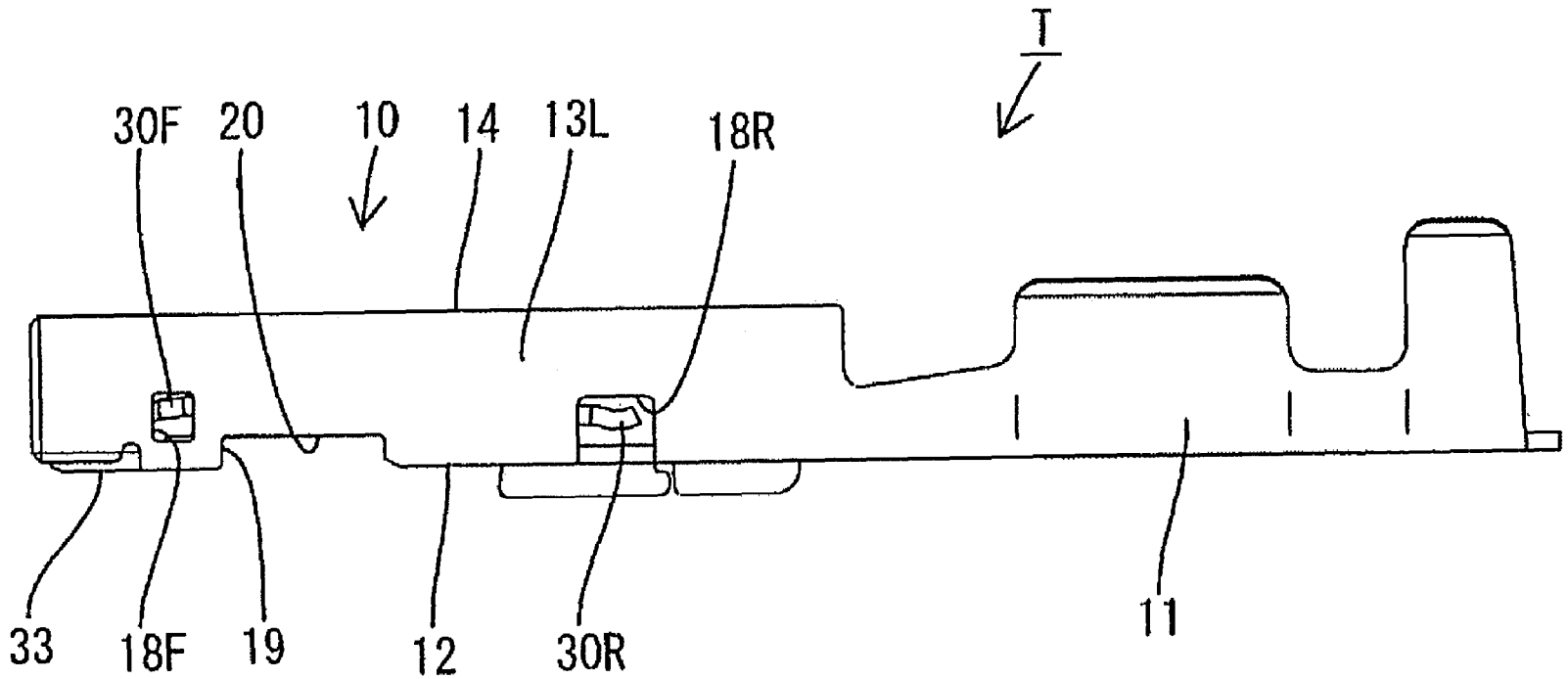
FIG. 1 is a right side view of a terminal fitting according to one embodiment of the invention.
Figure 2:
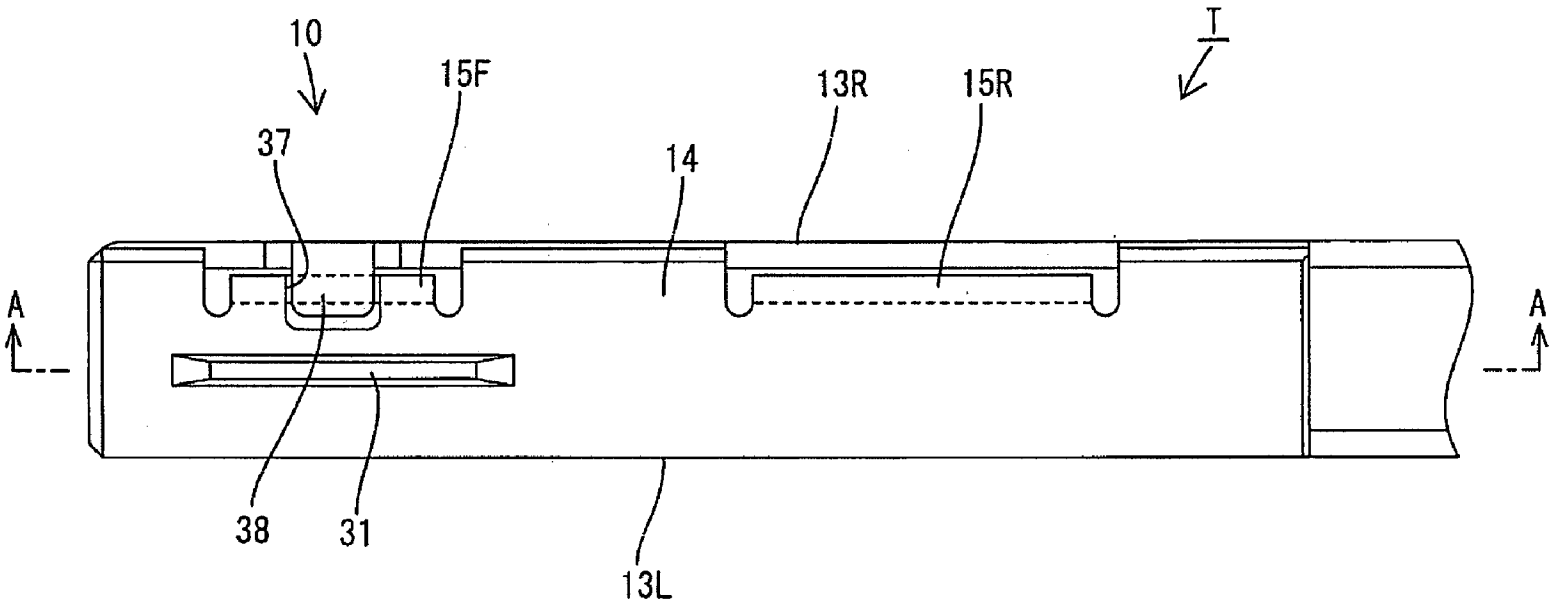
FIG. 2 is a plan view of the terminal fitting.
Figure 3:
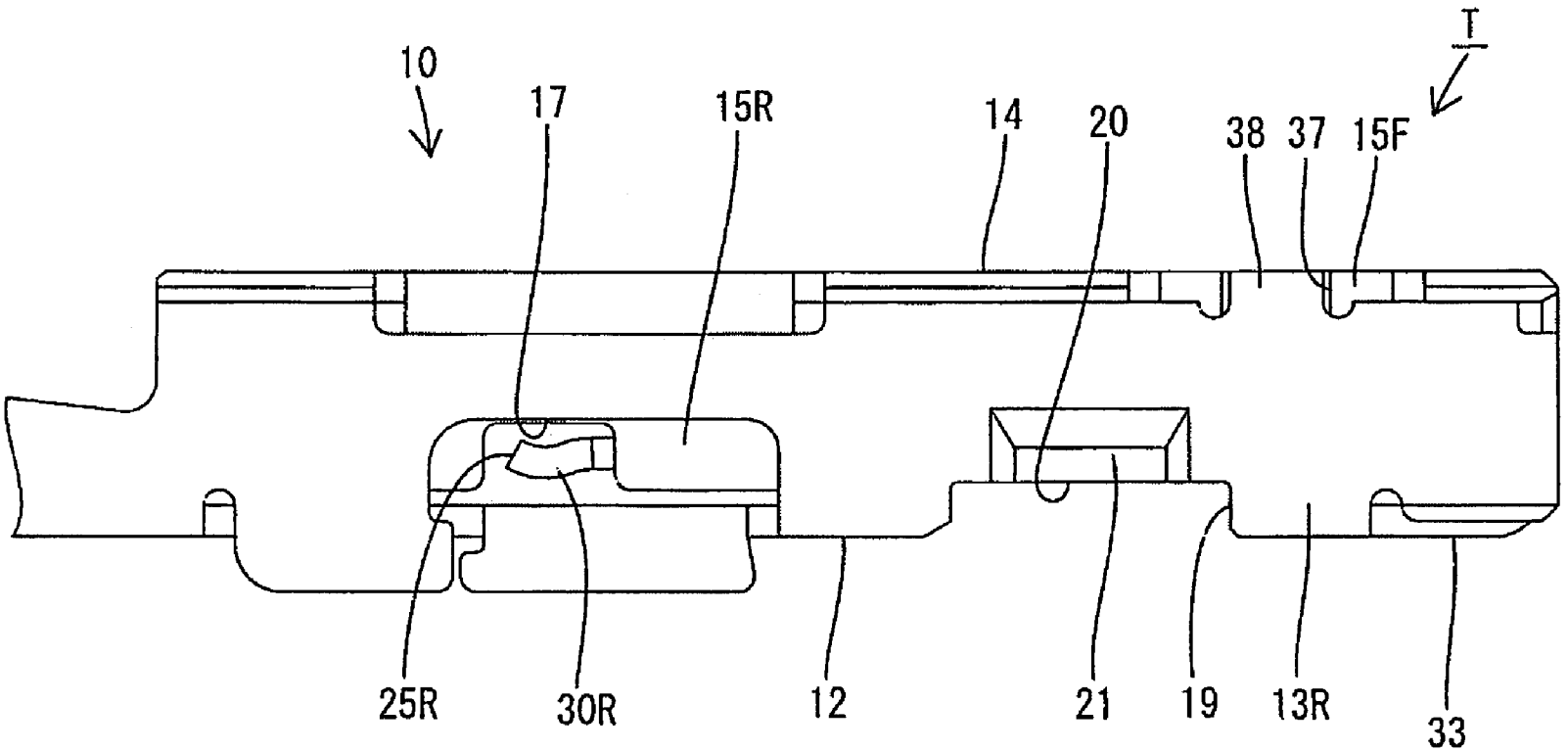
FIG. 3 is a left side view of the terminal fitting.
Figure 4:
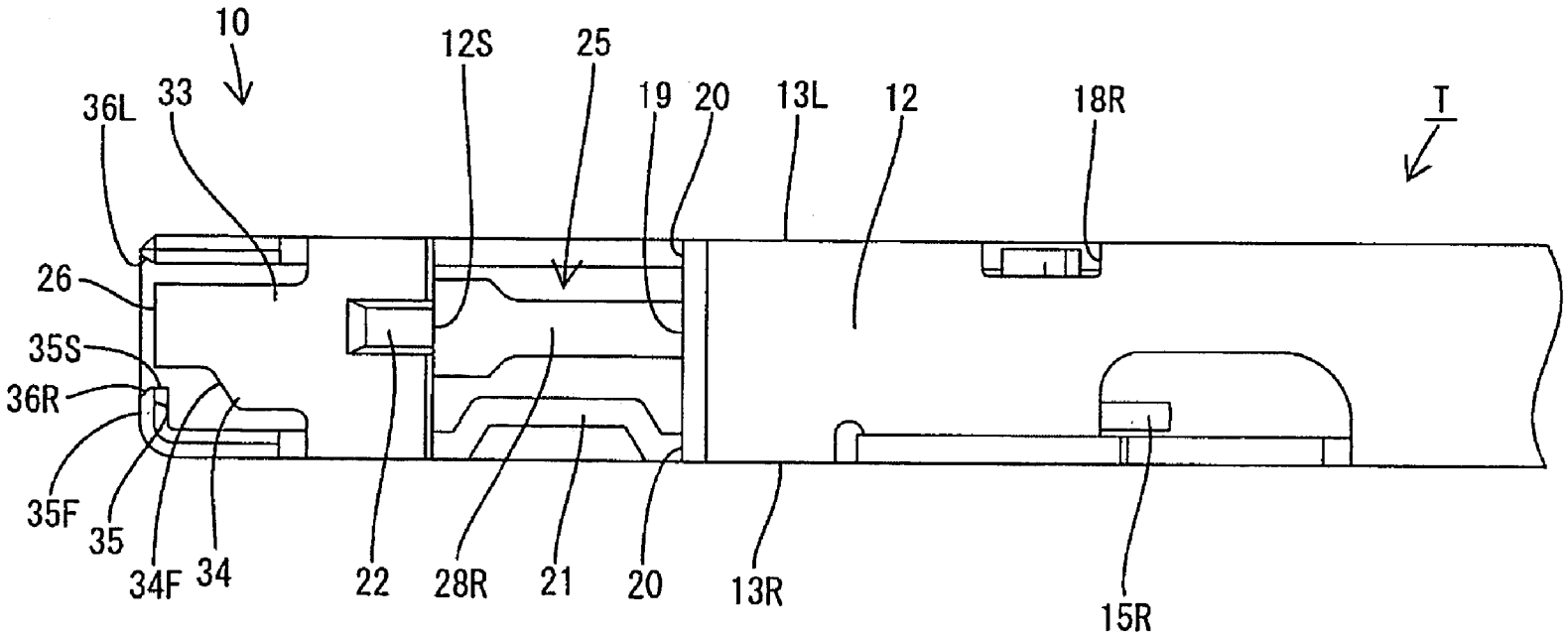
FIG. 4 is a bottom view of the terminal fitting.
Figure 5:
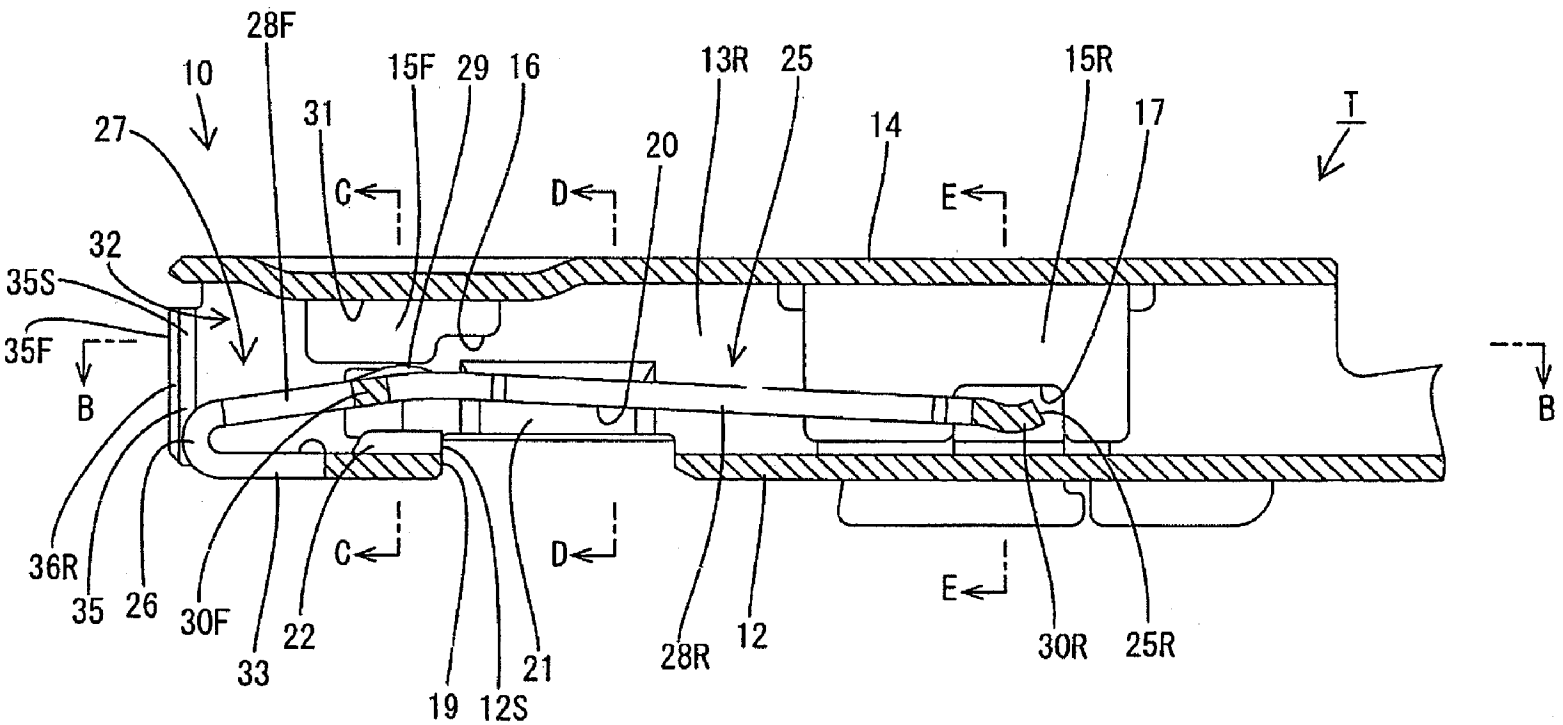
FIG. 5 is a section along 5—5 of FIG. 2.
Figure 6:
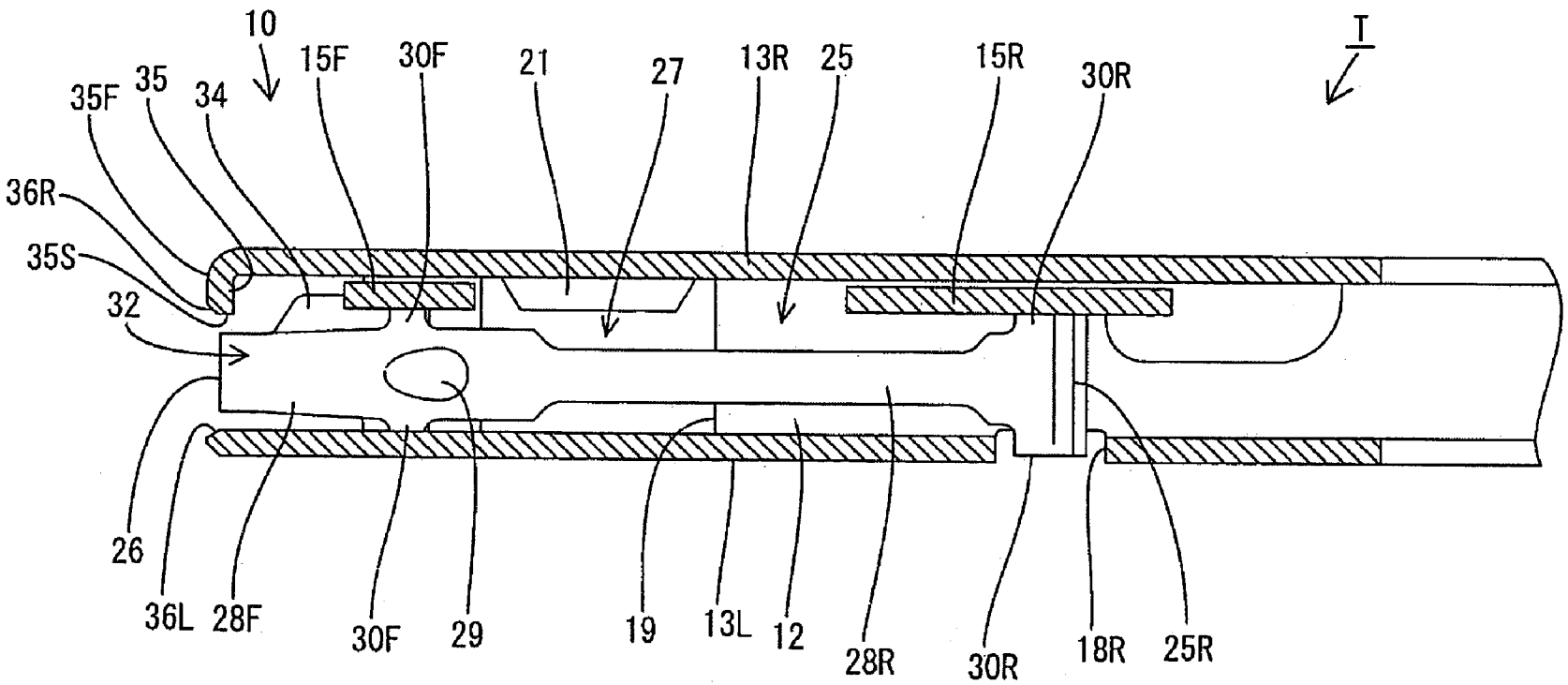
FIG. 6 is a section along 6—6 of FIG. 5.
Figure 7:
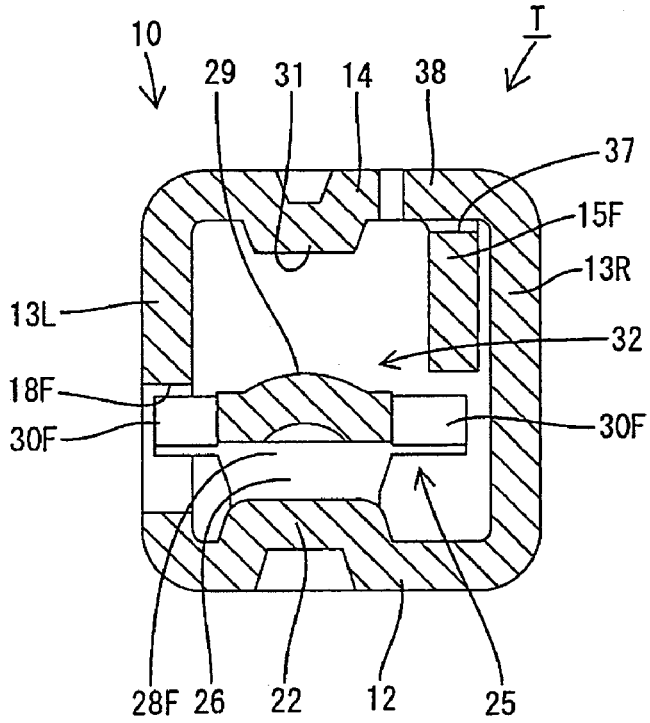
FIG. 7 is a section along 7—7 of FIG. 5.
Figure 8:
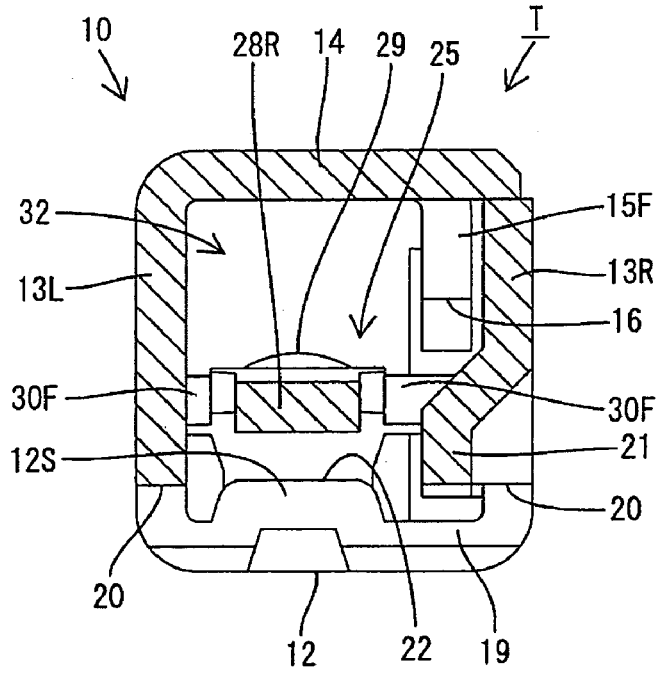
FIG. 8 is a section along 8—8 of FIG. 5.
Figure 9:
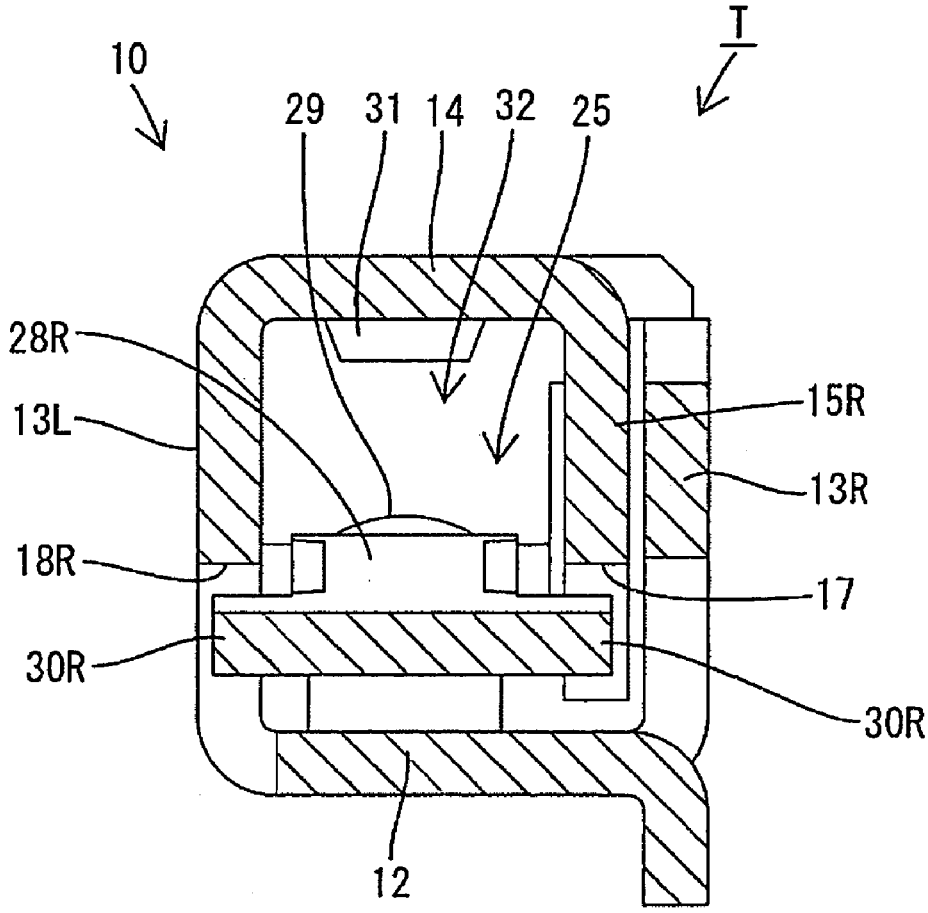
FIG. 9 is a section along 9—9 of FIG. 5.

A resilient contact 25 is accommodated in the rectangular tube 10. As shown in FIG. 5, the resilient contact 25 is long and narrow in forward and backward directions and is bent to cantilever back from the front end of the bottom plate 12. The resilient contact 25 has a substantially semicircular bend 26 connected with the front end of the bottom plate 12, and an extending portion 27 extending back from the bend 26. The extending portion 27 has a forward inclined portion 28F extending obliquely up and to the back from the upper end of the bend 26 and a backward inclined portion 28R extending obliquely down to the back from the rear end of the forward inclined portion 28F. In a free state where the resilient contact 25 is not resiliently deformed, the resilient contact 25 is supported only at its front end since a free end 25R of the resilient contact 25 is located at a noncontact position spaced up from the bottom plate 12. The resilient contact 25 is resiliently deformable substantially up and down in a direction intersecting the forward and backward directions with the bend 26 as a supporting point while mainly resiliently deforming the bend 26. When the resilient contact 25 is deformed down, the free end 25R of the resilient contact 25 contacts the upper surface of the bottom plate 12 so that the resilient contact 25 is supported at both front and rear ends.

The bend 26 and the forward inclined portion 28F are in an area before the locking hole 19, and a substantially dome-shaped contact point 29 projects up at the rear end (i.e. highest part) of the front forward portion 28F. This contact point 29 also is located before the locking hole 19. The backward inclined portion 28R extends in an area from the front edge of the locking hole 19 to the bottom notch 17 of the rear locking plate 15R, and the front end thereof is at a height substantially corresponding to the intrusion restricting portion 21. Further, the widths of the bend 26 and the forward inclined portion 28F are substantially equal; the widths of the front and rear ends of the backward inclined portion 28R are substantially equal to the width of the forward inclined portion 28F; and an area of the backward inclined portion 28R except the front and rear ends thereof is narrower than the forward inclined portion 28F.

Front and rear projections 30F, 30R are formed at each of the left and right edges of the resilient contact 25. The front and rear projections 30F, 30R are substantially flush with the resilient contact 25 in the thickness direction, but bulge outward transversely. The left and right front projections 30F are substantially symmetrical to each other and arranged slightly before the contact point 29. The front projections 30F substantially correspond to the bottom edge of the front locking plate 15F and the front locking hole 18F with respect to forward and backward directions. In the free state, where the resilient contact 25 is not deformed, the upper surface of the right front projection 30F is slightly below the bottom edge of the front locking plate 15F and does not contact the bottom edge, and the upper surface of the left front projection 30F is slightly below the upper edge of the front locking hole 18F and does not contact this upper edge. On the other hand, the rear projections 30R are transversely symmetrical and are close to the free rear end 25R of the resilient contact 25. The rear projections 30R are located to correspond to the upper edge of the bottom notch 17 of the rear locking plate 15R and the rear locking hole 18R with respect to forward and backward directions. In the free state, where the resilient contact 25 is not resiliently deformed, the upper surface of the right rear projection 30R is slightly below the upper edge of the bottom notch 17 and not in contact with this upper edge, and the upper surface of the left rear projection 30R is slightly below the upper edge of the rear locking hole 18R and not in contact with this upper edge.

The resilient contact 25 is substantially transversely symmetrical and displaced to the left along the width direction relative to the rectangular tube 10 and the locking hole 19. The widthwise center of the resilient contact 25 substantially coincides with that of the retaining portion 22. When the locking hole 19 is viewed from below, a front-end area of the backward inclined portion 28R of the resilient contact 25 is exposed over substantially its entire width. The ceiling plate 14 is embossed to project downward, thereby forming a tab receiving portion 31. The widthwise center of the tab receiving portion 31 also substantially coincides with that of the resilient contact 25. A space between the upper surface of the resilient contact 25 and the lower surface of the tab receiving portion 31 serves as the tab entrance space 32 for receiving the tab 54 inserted into the rectangular tube 10 from the front.

A base portion 33 is formed by cutting or stamping the left and right edges of a front end portion of the bottom plate 12. Thus, the base portion 33 is narrower than the bottom plate 12 and hence narrower than the substantially rectangular tube 10. Additionally, the base portion 33 is displaced laterally to the left relative to the rectangular tube 10 or its longitudinal axis. The widthwise center of the base portion 33 substantially coincides with the widthwise center of the resilient contact 25. Thus, the base portion 33 and the resilient contact 25 are arranged to have their widthwise centers located at the substantially same position. The bottom end of the bend 26 extends unitarily from the front end of the base portion 33, and the left edge of the base portion 33 and that of the bend 26 are substantially continuous and flush with each other. On the other hand, a bulge 34 bulges out laterally toward the right side plate 13R from the right edge of the base portion 33 (i.e. at the side edge substantially opposite to the side toward which the base portion 33 is displaced relative to the rectangular tube 10). The right edge of the bulge 34 is substantially parallel to the left edge of the base portion 33, and a front edge 34F of the bulge 34 is oblique to the side edges of the base portion 33 and the bulge 34. The widthwise center of a plate portion that comprises the base portion 33 and the bulge 34 substantially coincides with that of the rectangular tube 10.

A substantially flat receiving plate 35 extends from the front edge of the right side plate 13R substantially at right angle towards the widthwise center and towards the resilient contact 25. In this regard, the right side plate 13R is the side plate opposite the side towards which the widthwise center of the resilient contact 25 is deviated. The receiving plate 35 is continuous from a position near the upper end of the right side plate 13R to a position near the bottom end thereof, and has a vertically long substantially rectangular front view. The receiving plate 35 extends into a space left upon forming the base portion 33 and the bottom edge of the receiving plate 35 is located at least partly within the thickness area of the bottom plate 12 and the upper edge of the receiving plate 35 is substantially at the same height as the lower surface of the tab receiving portion 31. A front end surface 35F of the receiving plate 35 is located slightly before the front end of the resilient contact 25, and hence before the front end of the bend 26. An extending edge 35S of the receiving plate 35 is substantially straight and parallel to the right side plate 13R and is in an area between the inner surface of the right side plate 13R and the corresponding right surface of the bend 26 and more specifically at a position near the right edge of the bend 26 with respect to the width direction. Thus, the receiving plate 35 is outside the tab entrance space 32 between the tab receiving portion 31 and the resilient contact 25 with respect to the width direction. A slanted guide surface 36R is formed at the extending edge 35S of the receiving plate 35. On the other hand, a similarly slanted guide surface 35L is formed at the front end of the left side plate 13L. The widthwise center of a space defined between the extending edge 35S of the receiving plate 35 and the inner surface of the left side plate 13L substantially coincides with the widthwise centers of the base portion 33 and the resilient contact 25.

The top part of the front locking plate 15F and part of the ceiling plate 14 are cut away in an intermediate part with respect to forward and backward directions to form a recess 37. Therefore, the upper surface of the extending end of the ceiling plate 14 is recessed down (see e.g. FIG. 7) at the recess 37, and the recess 37 extends down through the lower surface of the ceiling plate 14 in an area of the recess 37 corresponding to the ceiling plate 14. A pressing portion 38 extends to the left from the top of the right side plate 13R and is accommodated in the recess 37. Thus, the upper surface of the pressing portion 38 is substantially flush with the upper surface of the ceiling plate 14. The pressing portion 38 contacts the upper edge of the front locking plate 15F from above to prevent an upward or outward displacement of both the front locking plate 15F and the ceiling plate 14.

The terminal fitting T is inserted into the cavity 51 from behind, with the front plate 43 held at the partial locking position. In the inserting process, the bottom plate 12 of the rectangular tube 10 contacts the retaining projection 52*a* to deform the lock 52 down. The lock 52 resiliently returns up towards the terminal fitting T when the terminal fitting T is inserted to a proper position. As a result, the retaining projection 52*a* enters the locking hole 19 and the front surface of the retaining projection 52*a* engages the retaining portion 22 of the locking hole 19 from behind to retain the terminal fitting T.

A long narrow conductive metallic probe P can be inserted through the work opening 56 from the front for checking an electrical connection of the inserted terminal fitting T. The probe P contact the upper end of the receiving plate 35 above the resilient contact 25 and at the height corresponding to the tab entrance space 32 and simultaneously contacts the front edge of the ceiling plate 14.

The front plate 53 is moved to the full locking position after checking the electrical connection. In this state, the tab 54 is inserted into the tab entrance space 32 through the tab insertion opening 55 of the front plate 53 from the front. The inserted tab 54 contacts the resilient contact 25 and is held resiliently between the tab receiving portion 31 and the contact point 29 while resiliently deforming the resilient contact 25. Thus, the tab 54 and the rectangular tube 10 are connected electrically by a resilient restoring force of the resilient contact 25.

The edge 12S of the retaining portion 22 at the opening of the locking hole 19 in the bottom plate 12 contacts the lock 52 to retain the terminal fitting T. The edge 12S is displaced inwardly of the rectangular tube 10. Thus, a larger engaging margin can be ensured as compared to a case where only the thickness of the plate serves as an engaging margin.

The retaining portion 22 is displaced inwardly of the rectangular tube 10 while the part of the edge 12S of the bottom plate 12 is held substantially faced in a direction to substantially oppose the lock 52, and a boundary between the lower surface of the bottom plate 12 and the edge 12S is well defined angle. Thus, even if an external force acts on the terminal fitting T in withdrawing direction, there is no likelihood that the lock will slip and disengage from the retaining portion as in the case where the boundary between the lower surface of the bottom plate and the end surface is a curve.

If a degree of downward deformation of the resilient contact piece 25 becomes larger than the one in a normal contact state of the resilient contact 25 with the tab 54 when the tab 54 is inserted, a portion of the resilient contact 25 corresponding to the contact point 29 contacts the retaining portion 22 from above and prevents the resilient contact 25 from deforming beyond its resiliency limit. The retaining portion 22 retains the terminal fitting T and also prevents excessive deformation of the resilient contact 25. Thus, the shape of the terminal fitting T can be simplified as compared to a case where an excessive deformation preventing portion for exclusive use is provided in addition to the retaining portion.

External matter that intrudes through the locking hole 19 could push the resilient contact 25 up from below. However, the front projections 30F contact the bottom edge of the front locking plate 15F and the edge of the front locking hole 18F from below, and the rear projections 30R contact the bottom edge of the rear locking plate 15R and the edge of the rear locking hole 18R from below to prevent the resilient contact 25 from being displaced up towards the tab entrance space 32. Further, the locking plates 15F, 15R and the locking holes 18F, 18R are arranged at positions before and behind the locking hole 19. Thus, there is no likelihood that the resilient contact 25 will incline forward and/or backward upon receiving a pushing force from external matter. As a result, the bend 26, which is the supporting point of resilient deformation of the resilient contact 25, will not be deformed plastically.

The front locking plate 15F and the front locking hole 18F located before the locking hole 19 are in the vicinity of the contact point 29 of the resilient contact 25 with the tab 54, even if an area of the resilient contact 25 other than the bend 26 is deformed. Thus, there is no likelihood of changing the position of the contact point 29. Therefore, the resilient contact 25 can contact the tab 54 with a proper contact pressure.

A rear displacement preventing portion (rear locking plate 15R and the rear locking hole 18R) is behind the locking hole 19 and near the free end 25R of the resilient contact 25. Thus, an interval along forward and backward directions between a front displacement preventing portion (front locking plate 15F and front locking hole 18F) and the rear displacement preventing portion (rear locking plate 15R and rear locking hole 18R) is longer than a case where the rear displacement preventing portion is closer to the supporting point of resilient deformation than to the free end. Accordingly, a degree of deformation of the resilient contact 25 when the resilient contact piece 25 is deformed between the front and rear displacement preventing portions by external matter can be suppressed, and the resilient contact 25 is unlikely to deform plastically between the front and rear displacement preventing portions.

The bottom plate 12 has the locking hole 19 for exposing the resilient contact 25 to the outside of the rectangular tube 10, but the right side plate 13R is formed with the intrusion restricting portion 21 close to the resilient contact 25 and located within the opening area of the locking hole 19. Thus, the intrusion of external matter into the locking hole 19 can be restricted by the intrusion restricting portion 21, which in turn prevents the interference of external matter with the resilient contact 25.

The intrusion restricting portion 21 is outside a deformation space for the resilient contact 25 with respect to the width direction. Thus, the interference of the resilient contact 25 and the intrusion restricting portion 21 can be avoided. Accordingly, the contact reliability of the tab 54 and the resilient contact 25 is ensured without hindering the resilient deformation of the resilient contact 25.

The widthwise center of the resilient contact 25 is deviated from that of the rectangular tube 10. This means the presence of a dead space between the resilient contact 25 and the right side plate 13R, which is a side plate more distant from the resilient contact 25. However, the intrusion restricting portion 21 is in this dead space and uses the dead space effectively.

The locking hole 19 is formed over substantially the entire width of the rectangular tube 10 and the exposure of the bottom end surfaces of the left and right side plates 13L, 13R of the rectangular tube 10 in the opening area of the locking hole 19. The bottom end of the right side plate 13R facing the locking hole 19 is embossed to project inward, thereby forming the intrusion restricting portion 21. The stamping or embossing forming method is easily workable as compared to cutting and bending. Therefore, a processing cost can be reduced.

The locking plates 15F, 15R extend from the extending of the ceiling plate 14 towards the bottom plate 12 substantially along the inner surface of the right side plate 13R, and the projections 30F, 30R at the right edge of the resilient contact 25 are brought substantially into contact with the bottom edges of the locking plates 15F, 15R to restrict displacement of the resilient contact 25 towards the tab entrance space 32. Thus, it is not necessary to form locking holes in the right side plate 13R and there is no reduction in the strength of the right side plate 13R or the rectangular tube 10 can be avoided.

The widthwise center of the inner space of the rectangular tube 10 where the resilient contact 25 is accommodated is deviated laterally from the widthwise center of the rectangular tube 10 because of the presence of the locking plates 15F, 15R. The resilient contact 25 would have to be narrowed by as much as this deviation if the resilient contact 25 and the rectangular tube 10 were to have their widthwise centers at the same widthwise position. However, a dead space is left at the side opposite the locking plates 15F, 15R in the inner space of the rectangular tube 10, and the widthwise center of the resilient contact 25 is deviated to the side opposite to the locking plates 15F, 15R. Therefore, a large width can be ensured for the resilient contact 25 and the dead space in the inner space of the rectangular tube 10 is minimized.

The pressing portion 38 can be brought into contact with the upper edge of the front locking plate 15F from above by extending towards the ceiling plate 14. Additionally, the recess 37 is formed at the extending edge of the right side plate 13R, and the front locking plate 15F has its upward or outward displacement prevented by the pressing portion 38. Thus, a displacement of the resilient contact 25 towards the tab entrance space 32 is prevented.

The upper edge of the front locking plate 15F is recessed to form the recess 37, and the pressing portion 38 is accommodated in the recess 37. Thus, there is no step between the upper surface of the ceiling plate 14 and that of the pressing portion 38 on the upper surface of the rectangular tube 10.

The pressing portion 38 formed at the upper edge of the right side plate 13R prevents an upward or outward displacement of the extending edge of the ceiling plate 14. The pressing portion 38 is accommodated in the recess 37. Thus, the height of the rectangular tube 10 is reduced by the absence of the step between the upper surface of the ceiling plate 14 and that of the pressing portion 38 on the upper surface of the rectangular tube 10.

The front locking plate 15F is formed with the recess 37 and extends substantially along the inner surface of the right side plate 13R. Thus, the front locking plate 15F reinforces the right side plate 13R, which in turn enhances the strength of the entire rectangular tube 10.

The receiving plate 35 extends from the front edge of the right side plate 13R substantially at a right angle and towards the resilient contact 25. Additionally at least part of the extending edge of the receiving plate 35 facing the tab entrance space 32 is in an area between the right side plate 13R and the resilient contact 25 along the width direction. Furthermore, the probe P is brought into contact with the receiving plate 35. Thus, a contact area of the probe P along the width direction is wider than the thickness of the right side plate 13R and the probe P can be brought securely into contact with the rectangular tube portion 10 even if displaced in the width direction. In addition, at least the part corresponding to the tab entrance space 32 along the height direction is in the area between the right side plate 13R and the resilient contact 25 along the width direction. Therefore, the receiving plate does not interfere with the tab 54 entering the tab entrance space 32.

The receiving plate 35 is formed over substantially the entire height of the right side plate 13R to increase the touchable area of the probe P along the height direction. Thus, a degree of freedom in designing is increased for setting the arrangement of the work openings 56 as the entrance openings for the probe P in the housing 50.

The widthwise center of the resilient contact piece could be made to coincide with that of the rectangular tube. In this case, the width of clearances between the side plates and the resilient contact would be substantially half the difference between the width of the rectangular tube and that of the resilient contact. Contrary to this, the widthwise center of the resilient contact 25 is deviated from that of the rectangular tube 10 in this embodiment. Thus, the width of the wider clearance between the side plate and the resilient contact 25 is larger than half the difference between the width of the rectangular tube 10 and that of the resilient contact 25. Accordingly, a large extending distance from the right side plate 13R can be ensured for the receiving plate 35.

The front end surface 35F of the receiving plate 35 is before the front end of the resilient contact 25. Thus, there is no likelihood of the probe P interfering with the resilient contact 25 even if part of the probe P does not touch the receiving plate 35.

The slanted guide surface 36R is formed at the extending edge of the receiving plate 35 and corrects the position of the tab 54 towards the tab entrance space 32 if the tab 54 is displaced towards the receiving plate 35. Accordingly, there is no likelihood that the tab 54 will strike the receiving plate 35.

The base portion 33 is formed narrower than the bottom plate 12 by cutting away the left and/or right edge(s) close to the front end of the bottom plate 12, and the bend 26 at the front end of the resilient contact 25 is connected with the front end of the base portion 33. The base portion 33 has the bulge 34 bulging out from the side edge of the base portion 33 toward the right side plate 13R of the rectangular tube 10. The bulge 34 narrows an area of the opening between the base portion 33 and the right side plate 13R and substantially prevents intrusion of external matter into the rectangular tube 10 through this opening. Further, the base portion 33 is wider and is reinforced by forming the bulge 34. Thus, a deformation of the base portion 33 resulting from the interference with external matter can be prevented even if the resilient contact 25 is narrow.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The bulge is formed only at the right lateral edge of the base portion in the foregoing embodiment. However, the base may be formed only at the left lateral edge of the base portion or may be formed at both lateral edges thereof. In the case of forming the bulges at both lateral edges, the bulges may be transversely symmetrical or asymmetrical.

The front edge of the bulge is oblique to the forward and backward directions of the resilient contact in the foregoing embodiment. However, the front edge of the bulge may be substantially normal to the longitudinal direction of the resilient contact or may be curved.

The widthwise centers of the resilient contact and the base are deviated from that of the rectangular tube in the foregoing embodiment. However, the invention is also applicable to terminal fittings in which the widthwise centers of resilient contact pieces and base portions and those of rectangular tube substantially coincide.

The tube preferably has a substantially rectangular cross-sectional shape. However, the invention is equally applicable to tubes having other cross-sectional shapes, particular substantially polygonal (triangular, pentagonal, hexagonal, etc.) shapes or round, circular, elliptic shapes.

What is claimed is:

1. A terminal fitting with opposite front and rear ends, the terminal fitting comprising a substantially rectangular tube formed at the front end and having a base plate, a ceiling plate opposed to the base plate and first and second opposed side plates extending from the base plate to the ceiling plate, a base portion extending forward from a front end of the base plate, the base portion being narrower than the base plate, a resilient contact provided in the tube and configured for contacting a tab inserted into the tube, the resilient contact being substantially long and narrow along forward and backward directions and having a substantially U-shaped bend continuous with a front of the base portion and defining a support for resilient deformation of the resilient contact, an extending portion extending back from the bend, and a bulge bulging out from a lateral edge of the base portion towards one of the side plates of the tube.

2. The terminal fitting of claim 1, wherein widthwise centers of the resilient contact and the base portion are deviated from a widthwise center of the tube.

3. The terminal fitting of claim 2, wherein the bulge is formed only at the lateral edge substantially opposite to a side towards which the widthwise center of the base portion is deviated.

4. The terminal fitting of claim 1, wherein the front edge of the bulge is oblique to a longitudinal direction of the resilient contact.

5. The terminal fitting of claim 1, further comprising at least one pressing portion for preventing an outward displacement of the ceiling plate from an edge of first side plate opposite the base plate, an extending edge of the ceiling plate having at least one recess for receiving at least part of the pressing portion.

6. The terminal fitting of claim 1, wherein the bend is formed about an axis substantially transverse to the forward and backward directions.

* * * * *